US005465878A

United States Patent [19]

Armijo et al.

[11] Patent Number: 5,465,878

[45] Date of Patent: Nov. 14, 1995

[54] PORTABLE HOUSEHOLD WATER DISPENSER

[76] Inventors: Orlando M. Armijo, 7100 Constitution NE.#42, Albuquerque, N.M. 87110; George Spector, 233 Broadway Rm 702, New York, N.Y. 10279

[21] Appl. No.: 332,367

[22] Filed: Oct. 31, 1994

[51] Int. Cl.[6] ..... B67D 5/06

[52] U.S. Cl. ..... 222/181.2; 222/192; 222/181.3

[58] Field of Search ..... 222/192, 180, 222/181; 248/340

[56] References Cited

U.S. PATENT DOCUMENTS

| | | | |
|---|---|---|---|
| 819,248 | 5/1906 | Organ | 222/181 |
| 2,708,540 | 5/1955 | Cook et al. | 222/181 X |
| 4,280,643 | 7/1981 | Cordova et al. | 222/181 X |
| 4,436,224 | 3/1984 | McInerny | 222/181 X |
| 4,964,543 | 10/1990 | Scheiber | 222/180 |

*Primary Examiner*—Gregory L. Huson

[57] ABSTRACT

A water caddy comprising a box-shaped housing having a threaded neck for the insertion of water therein. A lid having internal threads engages with the threaded neck. A spout is on a lower portion of a front wall of the housing, for dispensing the water out of the housing, so that the water can be used for washing and drinking. A structure on the housing is for connecting the housing to a toilet paper holder. In a first instance, the housing can hang down against a wall and cabinet. In a second instance, the holder can be used as a handle for a person to carry the housing.

1 Claim, 1 Drawing Sheet

PORTABLE HOUSEHOLD WATER DISPENSER

BACKGROUND OF THE INVENTION

The instant invention relates generally to liquid dispensers and more specifically it relates to a water caddy, which provides a structure that can supply water to a person for washing and drinking.

There are available various conventional liquid dispensers which do not provide the novel improvements of the invention herein disclosed.

SUMMARY OF THE INVENTION

A primary object of the present invention is to provide a water caddy that will overcome the shortcomings of the prior art devices.

Another object is to provide a water caddy that can be mounted to a toilet paper holder or be free standing, so as to supply water to a person for washing and drinking.

An additional object is to provide a water caddy that is constructed so that it can be mounted quickly to a toilet paper holder without having to dismantle the holder from a wall or cabinet.

A further object is to provide a water caddy that is simple and easy to use.

A still further object is to provide a water caddy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
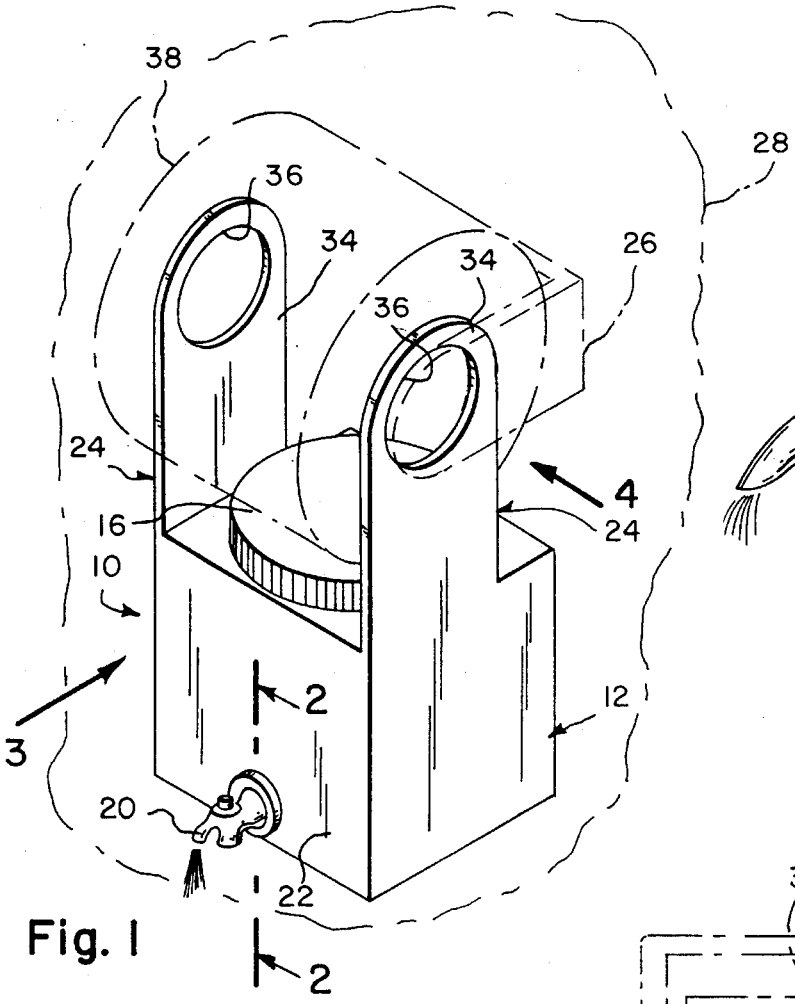
FIG. 1 is a perspective view of the instant invention mounted onto a toilet paper holder shown in phantom.
Figure 2:
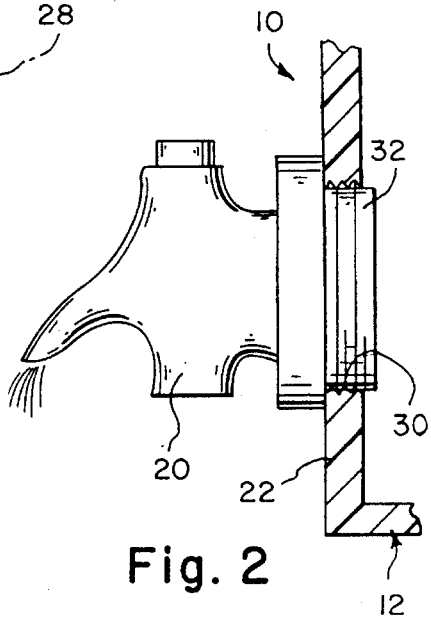
FIG. 2 is an enlarged cross sectional view taken along line 2—2 in FIG. 2, showing the screw-in spout in greater detail.
Figure 3:
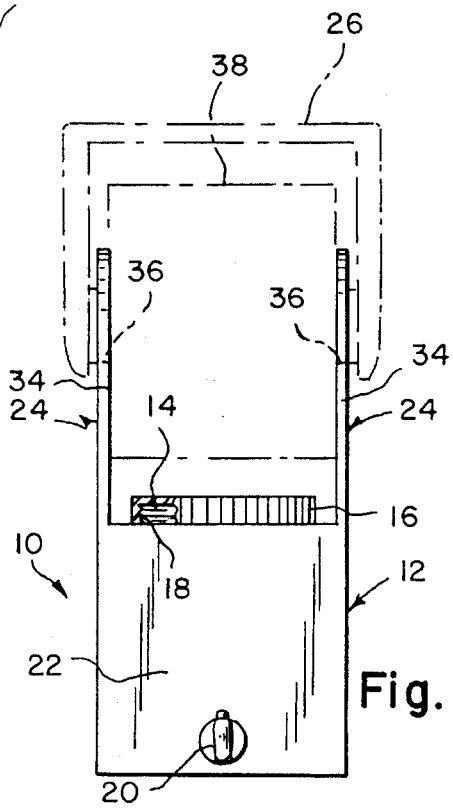
FIG. 3 is a front view taken in the direction of arrow 3 in FIG. 1, showing the toilet paper holder being used as a handle to carry the water caddy.

Turning now descriptively to the drawings, in which similar reference characters denote similar elements throughout the several views, FIGS. 1 through 4 illustrate a water caddy 10 comprising a box-shaped housing 12 having a threaded neck 14 for the insertion of water therein. A lid 16 has internal threads 18 to engage with the threaded neck 14. A spout 20 is on a lower portion of a front wall 22 of the housing 12, for dispensing the water out of the housing 12, so that the water can be used for washing and drinking. A structure 24 on the housing 12 is for connecting the housing 12 to a toilet paper holder 26. In a first instance, as best seen in FIG. 1, the housing 12 can hang down against a wall or cabinet 28. In a second instance, as shown in FIG. 3, the holder 26 can be used as a handle for a person to carry the housing 12.

As shown in FIG. 2, the front wall 22 has an internal threaded aperture 30 in the lower portion. The spout 20 has an external threaded sleeve 32, so that the sleeve 32 can be screwed into the internal threaded aperture 30.

The connecting structure 24, in FIG. 1 and 3, consists of a pair of upstanding arms 34. Each arm 34 has a hole 36 therethrough, so that the toilet paper holder 26 can contact the holes 36 in the arms 34, while allowing a roll of toilet paper 38 to be used therefrom.

Figure 4:
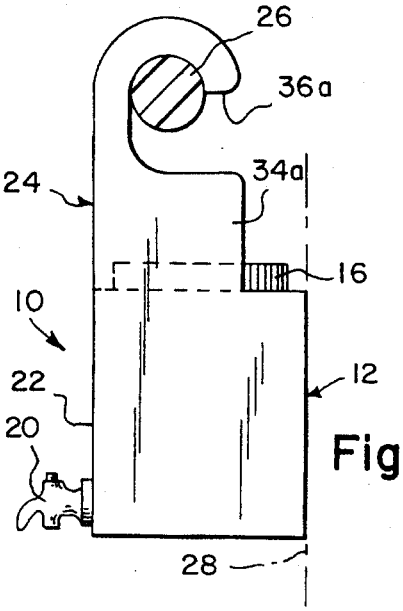
FIG. 4 is a side view taken in the direction of arrow 4 in FIG. 1 of a modification, showing an L-shaped slot for mounting the water caddy on a toilet paper holder shaft.

In FIG. 4, the pair of upstanding arms **34*a* have a rearwardly extending L-shaped slot 36a therethrough. The arms 34*a* can be mounted quickly to the toilet paper holder 26 without having to dismantle the holder 36 from the wall or cabinet 28**.

OPERATION OF THE INVENTION

To use the water caddy 10, a person simply inserts the apertures 36 of the arms 34, or the slots **36*a* of the arms 34*a*, into the toilet paper holder 26. If the holder 26 is mounted to the wall or cabinet 28, the housing 12 will hang down therefrom. If the holder 26 is not mounted it can be used as a handle to carry the housing 12. Water can be dispensed from the spout 20** for washing or drinking.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A water caddy comprising:

a) a box-shaped housing having front, rear, side and top walls, a threaded neck in said top wall for the insertion of water therein;

b) a lid having internal threads to engage with said threaded neck;

c) a spout on a lower portion of a front wall of said housing, for dispensing the water out of said housing, so that the water can be used for washing and drinking;

d) means on said housing for connecting said housing to a toilet paper holder, so that in a first instance said housing can hang down vertically against a wall and cabinet and in a second instance the holder can be used as a handle for a person to carry said housing; further including:

e) said front wall having an internal threaded aperture in the lower portion;

f) said spout having an external threaded sleeve, so that said sleeve can be screwed into said internal threaded aperture, wherein said connecting means includes a pair of spaced parallel arms, with each said arm having a rearwardly extending L-shaped slot therethrough, so that said arms can be mounted quickly to the toilet paper holder without having to dismantle the holder from the wall and cabinet; wherein said arms extend from and in vertical alignment with said front and side walls, each said arm having a rear edge vertically spaced forward from said rear wall providing convenient access to said lid and whereby said housing will hang vertically.

* * * * *